United States Patent [19]

Blank

[11] 3,984,045

[45] Oct. 5, 1976

[54] CANOPENER END

[75] Inventor: Robert O. Blank, Troy, Ohio

[73] Assignee: Container Corporation of America, Chicago, Ill.

[22] Filed: Dec. 15, 1975

[21] Appl. No.: 640,475

[52] U.S. Cl. ..... 229/5.6; 220/67

[51] Int. Cl.[2] ..... B65D 3/10; B65D 7/36

[58] Field of Search ..... 220/67, 79; 229/5.5, 229/5.6

[56] References Cited

UNITED STATES PATENTS

| | | | |
|---|---|---|---|
| 1,463,088 | 7/1923 | Lynch | 220/67 UX |
| 2,181,569 | 11/1939 | Mackenzie | 229/5.6 X |
| 2,346,165 | 4/1944 | Hothersall | 220/67 X |
| 2,727,673 | 12/1955 | Bergstrom | 229/5.5 X |
| 3,142,280 | 7/1964 | Heinle | 220/67 X |
| 3,330,436 | 7/1967 | Slomski | 229/5.6 X |
| 3,409,200 | 11/1968 | Balocca et al. | 229/5.6 |

*Primary Examiner*—Davis T. Moorhead

*Attorney, Agent, or Firm*—Carpenter & Ostis

[57] ABSTRACT

A composite can having a tubular paperboard body and a metal end which includes a skirt encompassing a marginal portion of the can body.

1 Claim, 7 Drawing Figures

CANOPENER END

SUMMARY OF THE INVENTION

The invention relates to composite cans of the type which have tubular bodies formed of paperboard and which have metal ends without easy opening devices.

In cans of this type which do not have easy opening features, it is necessary to open the ends with a can opener of one type or the other. Most can openers in use today, whether electric or mechanical, include a cutting wheel engageable with the can end, for severing the central portion of the lid from the peripheral flange, and a propelling gear engageable with the can seam and outside of the can body wall for rotating the can against the cutting wheel.

One problem frequently encountered with cans of this type is that the can opener gear tends to "chew" up the adjacent end portion of the paperboard body wall, and sometimes the wall becomes so deformed that it is impossible or extremely difficult to continue or finish opening the can with the mechanical can opener.

It is therefore an object of the invention to provide, in a can of the type described, a composite can with a protective skirt to prevent a can opener gear from damaging the can body.

A more specific object of the invention is the provision of a composite can with a paperboard body and a metal end having a peripheral flange joined to the body wall in a seam which includes an integral skirt encompassing a portion of the can body wall.

These and other objects of the invention will be apparent from an examination of the following drawing and description.

THE DRAWINGS

It will be understood that, for purposes of clarity, certain elements may have been intentionally omitted from certain views where they are believed to be illustrated to better advantage in other views.

THE DESCRIPTION

Figure 1:
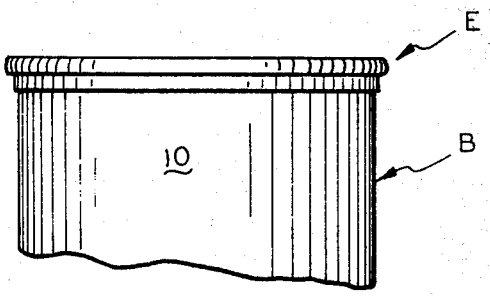
FIG. 1 is a fragmentary side elevation of a composite can embodying features of the invention.

Referring now to the drawings for a better understanding of the invention, it will be seen in FIG. 1 that there is illustrated a composite can embodying feature of the invention which includes a body indicated generally at B which is formed of a deformable material such as paperboard and a can end indicated generally at E which is formed of a more rigid material such as metal.

Figure 6:
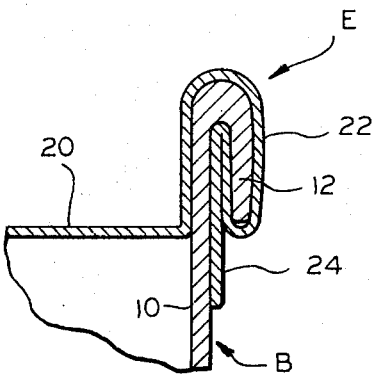
FIG. 6 is a fragmentary, longitudinal section of a corner of the can illustrated in FIG. 1 showing the details of the can end seam and protective skirt.
Figure 2:
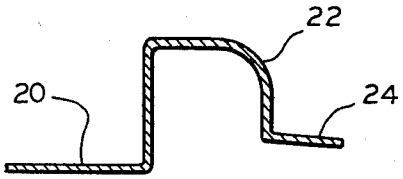
FIGS. 2 through 5 are fragmentary side elevations illustrating the sequential steps of the seam forming operation by which the can end flange is united to the end of the can body wall.
Figure 3:
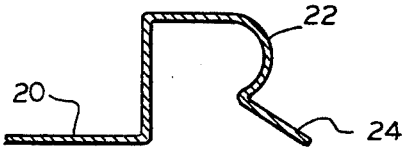
Figure 7:
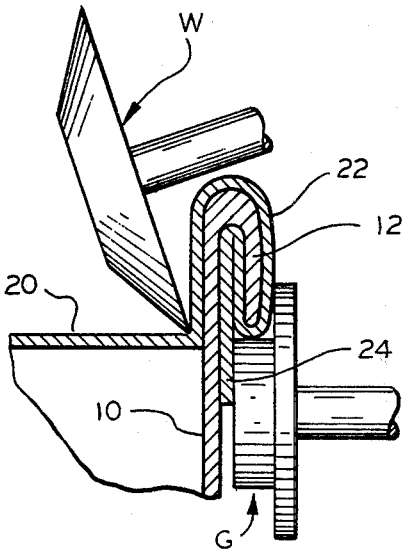
FIG. 7 is a view similar to FIG. 1 but enlarged to illustrate the manner in which the can skirt serves to protect the can body from deformation by movable parts of a can opener.
Figure 4:
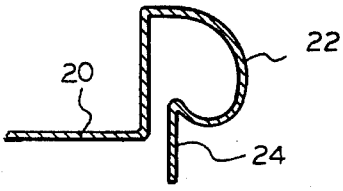
Figure 5:
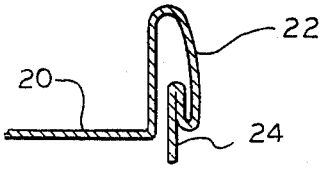

As best seen in FIGS. 6 and 7, the can body B includes a preferably cylindrical, tubular body wall 10 having an end portion 12 joined to the can end by a coventional type of seam. The seam may be either an interlocking or double seam as shown in the drawing, or a single seam if desired. In either case the principle of the invention is the same.

It will be seen that the can end E includes a generally flat disc-like central portion 20, the periphery of which has been curled as illustrated in FIGS. 2 through 5 to form a flange 22 for uniting the can end to the can body in a seaming operation.

The essential feature of this invention resides in the provision of an extension 24 on the flange 22 which extension is generally cylindrical in shape and encompasses the upper portion of the can body wall 10 immediately below the can end seam or flange 22.

As best seen in FIG. 7, protective skirt 24 is so positioned that when the can end is applied to a mechanical can opener having a cutting wheel W and a propelling gear G, the protective skirt 24 is positioned between the can body and the gear G to prevent contact between the gear and the can body and thereby prevent the former from damaging the latter.

Although the primary purpose of the skirt is to prevent the can body from being damaged by a can opener gear, the skirt also protects the can body from being damaged by flanges or seams of adjacent cans when a plurality of cans are packed in an outer shipping container. Although only one end of the can is illustrated in the drawing, it is understood that the opposite end of the can may be formed in a conventional manner or provided with the novel skirt arrangement illustrated herein.

I claim:

1. In an end closure arrangement for a composite can, the combination of:

a. a can body including a tubular body wall formed of a deformable material, such as paperboard;

b. a can end formed of a more rigid material, such as metal;

c. said can end including a peripheral flange which is joined to an adjacent end portion of said can body wall by a seam;

d. said flange including a tubular extension forming a skirt encompassing a marginal portion of said can body wall adjacent said seam to protect said can body wall.

* * * * *